United States Patent [19]

Stevens et al.

[11] 4,343,719

[45] Aug. 10, 1982

[54] PULSE FOG GENERATOR

[75] Inventors: Robert E. Stevens; John H. Stowe; Jeremiah M. Emerich, all of Westfield, Ind.

[73] Assignee: Curtis Dyna-Products, Westfield, Ind.

[21] Appl. No.: 221,892

[22] Filed: Dec. 31, 1980

[51] Int. Cl.[3] ..... B01F 3/02; B01F 3/04; B01J 13/00

[52] U.S. Cl. ..... 252/359 CG; 43/129; 43/132 A; 239/129; 261/DIG. 8; 261/DIG. 68

[58] Field of Search ..... 252/359 CG; 261/DIG. 8, 261/DIG. 68; 43/129, 132 A; 239/129, 137, 138

[56] References Cited

U.S. PATENT DOCUMENTS 2,857,332 10/1958 Tenney et al.

2,959,214 11/1960 Durr et al. ..... 239/129

3,151,454 10/1964 Curtis .

3,275,305 9/1966 Nutten ..... 261/DIG. 68

3,371,658 3/1968 Turner ..... 261/DIG. 68

3,855,148 12/1974 Locher et al. ..... 252/359 CG 3,993,582 11/1976 Curtis .

*Primary Examiner*—Bradley Garris

*Attorney, Agent, or Firm*—Woodard, Weikart, Emhardt & Naughton

[57] ABSTRACT

Disclosed is a pulse-jet engine powered, fog producing device using a carburetor to feed atomized fuel to the engine combustion chamber, the carburetor operation being characterized by a positive pressurization of a diaphragm-walled chamber to open a fuel inlet valve during the engine starting interval, and provision of a positive pressure fuel delivery to the carburetor utilizing the combustion pressure pulses of the engine as the fuel pumping impetus.

2 Claims, 2 Drawing Figures

PULSE FOG GENERATOR

BACKGROUND OF THE INVENTION

Fogging devices, used to generate an insecticide fog, for example, and utilizing the pulse-jet (resonant intermittant combustion) principle, are well known in the prior art. An example of such a device is disclosed in Tenney et al, U.S. Pat. No. 2,857,332 and pulse-jet engine operation is there explained in some detail. A fogging apparatus utilizing a resonant, intermittant combustion device, a fuel supply, an insecticide supply and a starting device is disclosed in Curtis U.S. Pat. Nos. 3,151,454 and 3,993,582. The fuel feeding scheme of the early devices, such as disclosed in the Tenney et al patent, delivered fuel to the engine by aspiration from a constant level fuel supply.

Curtis U.S. Pat. No. 3,151,454 introduced pressurization of the fuel tank as a means for delivering fuel to the engine. The apparatus of the present invention is an improved version of such prior art devices characterized by positive pumping of the fuel supply using the combustion pulses of the engine to provide the pumping impetus and by the pressurization of a diaphragm-walled chamber, during the engine starting interval, to open the fuel inlet valve. In the apparatus of the present invention there is no pressurization of the fuel tank while the engine is in full operation, such pressurization occuring only during the short, initial starting interval. The fuel system of the apparatus responds rapidly to a change in air flow through the carburetor (caused, for example, by introduction of insecticide formulation into the engine exhaust stream) by correspondingly altering fuel flow. Proper operation of the fuel system is substantially independent of changes in the tilt angle or physical orientation of the apparatus. Flooding out of the combustion system by momentarily supplying too much fuel for existing air flow, a difficulty to which prior art devices are prone, is substantially eliminated in the apparatus of the present invention.

DESCRIPTION OF THE PREFERRED EMBODIMENT

Figure 1:
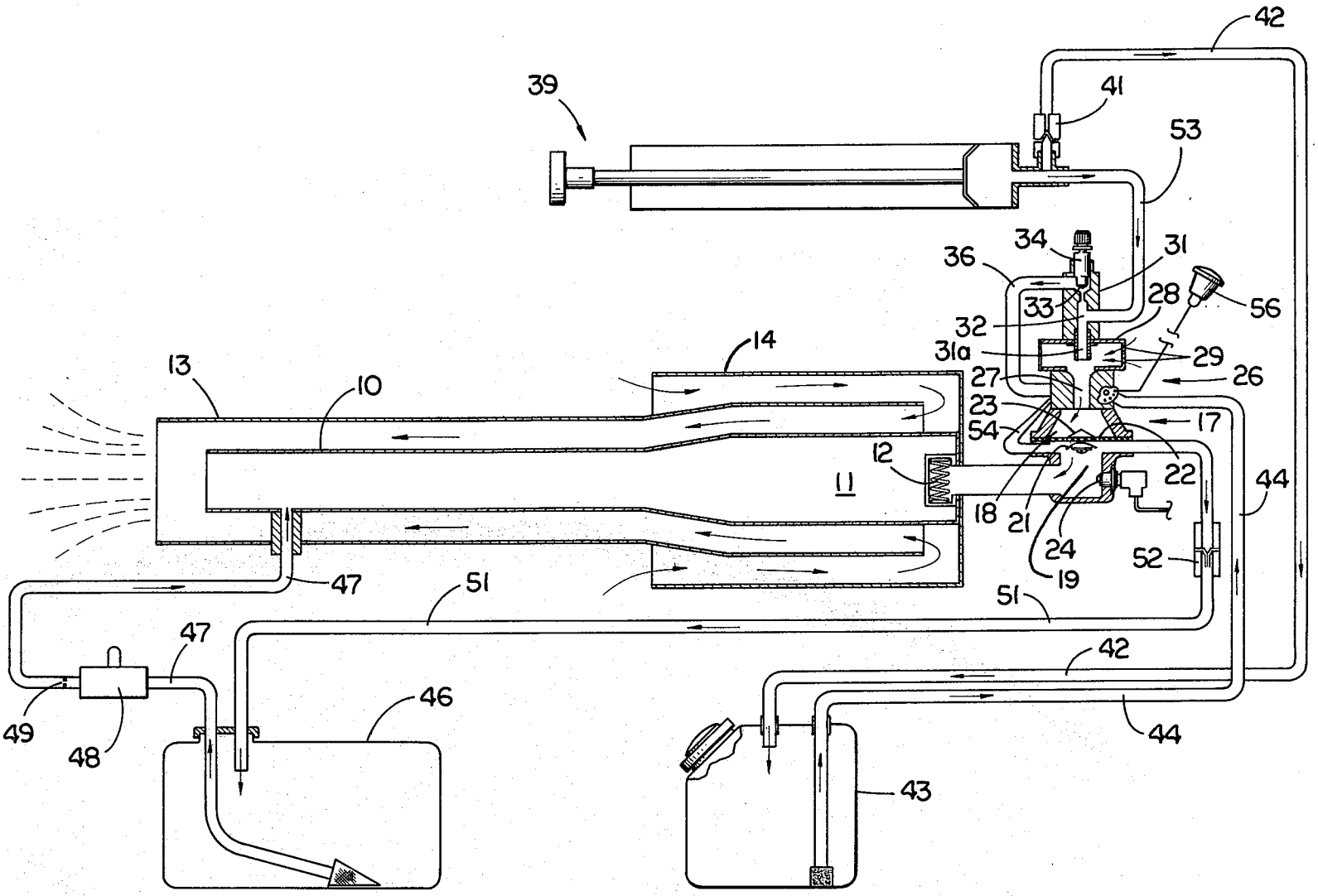
FIG. 1 is a schematically drawn side sectional view of a pulse fog generator embodying the present invention.

Referring initially to FIG. 1 the various components of the pulse fog generator are schematically shown with interconnecting tubing. The apparatus includes an exhaust tube 10, communicating at one end with a combustion chamber 11, the combustion chamber having a thermal glow coil, known in the prior art, identified at 12 and functioning as a flame holder. The opposite end of the exhaust tube extends, in spaced relation, through a discharge tube 13. A cylindrical housing 14 encircles the rear end of the discharge tube and provides a sinuous path for cooling air to enter and flow outwardly between the tubes 10 and 13 as indicated by arrows in FIG. 1.

Flow of fuel and air into a combustion antechamber 19 and thence into the combustion chamber 11 is controlled by a fuel-air inlet valve, indicated generally at 17, comprising a housing which is transversely divided by a conventional petal-type check valve into an upper chamber 18 and the combustion antechamber 19. The petal-type check valve is conventional and the flexible member 21 (shown in flexed, open position) permits one-way introduction of a combustible fuel-air mixture through the apertures 22 into the combustion antechamber 19. The valve also includes a conventional conical deflector 23. An electrical spark ignition means 24 has electrodes extending into the combustion antechamber 19 and is energized by switching means, not shown, during starting of the engine.

A carburetor, indicated generally at 26, is disposed above the valve 17 and has a central throat passage 27. A housing 28, just above the carburetor throat, has primary air inlet apertures 29 and supports a member 31 having a central bore 32. The bore 32 at its upper end is provided with a needle valve seat 33 which may be closed by manipulation of the clearing stem 34. When open, as is the case in normal starting operation, the valve 33–34 communicates with the passage 36 which extends to a secondary or further chamber 37 (FIG. 2) which has a pressure responsive means in the form of a diaphragm 38 forming one of its walls and bleed opening 40 to atmosphere for bleeding pressure from chamber 37 over a time interval.

Returning to FIG. 1, there is shown a starting air pump 39 which, through check valve 41, has a bleed-off aperture and air line 42, pressurizes fuel tank 43 during the engine starting interval. The fuel delivery line 44 delivers fuel to the suction side of a diaphragm fuel pump in carburetor 26 and subsequently described with reference to FIG. 2. Insecticide formulation is delivered from tank 46 through line 47 controlled by a formulation on-off valve 48 and containing a formulation metering orifice 49. Formulation is delivered by line 47 to the exhaust tube 10 and is vaporized by the hot, pulsing exhaust gases to be recondensed to liquid fog (micron sized) particles at the mouth of tube 13. The tank 46 is pressurized, during the fogging operation with the engine running, through line 51 which communicates with the combustion antechamber 19 through check valve 52 which has a bleed-off orifice permitting the tank pressure to fall when combustion ceases. The rapid combustion pressure pulses of the engine, as combustion proceeds, thus serves to pressurize the formulation tank, this procedure being, however, conventional.

A branch line 53 from pump 39 delivers starting air to the bore 32. A line 54 extends between the combustion antechamber 19 and the interior of carburetor 26 for a purpose to be subsequently described with reference to FIG. 2. An on-off control member 56 positions in either open or closed position a butterfly valve 57 (shown only in FIG. 2) which, when closed, stops all flow of air and vaporized fuel through the carburetor throat 27. The valve member 57 is spring-loaded to closed position and is held open by the control member 56 in a detent position.

Figure 2:
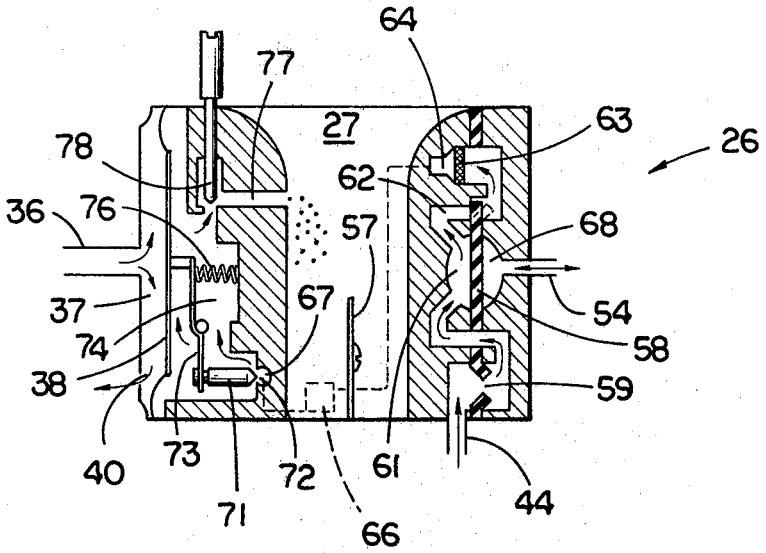
FIG. 2 is a schematic, detailed, cross-sectional view of the carburetor component of the apparatus shown in FIG. 1.

Referring to FIG. 2, the carburetor 26 is shown in schematic detail and includes a diaphragm pump formed by a flexible pumping element or diaphragm 58 having a flexure controlled check-flow opening 59 (shown as flexed open to admit fuel from line 44 in FIG. 2) through which fuel may flow on the suction stroke of the diaphragm. The fuel flows into chamber 61 and, on the discharge stroke of diaphragm 58, flows through discharge passage 62 (the diaphragm discharge passage portion being shown in closed position in FIG. 2), filter 63, and to the pump discharge side 64. From passage 64 the fuel is routed to a small fuel reservoir 66 and thence to the passage 67. The line 54 transmits combustion pressure pulses from the combustion antechamber 19 (FIG. 1) to the chamber 68 on the sealed, opposite side of diaphragm 58. The diaphragm 58 thus provides a fuel pumping action by the rapid (sixty to eighty pulses per second) combustion pressure pulses of the engine.

The passage 67 is formed to provide, with movable member 71, a needle type, metering, fuel inlet valve 72 (shown in open position). The member 71 is carried on pivoted lever arm 73 mounted in the chamber 74. A compression spring 76 resiliently urges the arm 73 against the metering diaphragm 38 (and urges member 71 to valve closed position) the diaphragm functioning as the common, movable wall between the primary chamber 74 and the further chamber 37. An aspirating passage 77 communicates with carburetor throat 27 and with the chamber 74 through a manually adjustable needle valve 78 which may be utilized to initially calibrate the fuel feed to the engine, fuel being vaporized and drawn from passage 77 through aspiration caused by air flow through throat 27.

In starting, assuming that clearing stem 34 is in normal, open position, the starting air pump 39 is stroked repeatedly which builds up the pressure in the fuel tank 43 sufficient to initially force fuel to the carburetor 26 through line 44 and thence to fuel reservoir 66 in the carburetor. Air from the pump 39 is also applied (through line 36) to the reverse side of the metering diaphragm 38, that is, to the further chamber 37. The motion of the diaphragm opens the inlet valve 72 slightly allowing a small amount of fuel from reservoir 66 into the intake valve cavity. Further flow of air from the starting pump flows through passage 31*a* (FIG. 1) in the housing 31 and enters carburetor throat 27 aspirating vaporized fuel through the passage 77. The mixture of air and vaporized fuel moves through apertures 22 into the antechamber 19 and combustion chamber 11 where it is ignited by spark plug 24. The explosion resulting from fuel ignition occurs in the combustion chamber and drives the gases out of the engine tube 10. Negative pressure in the antechamber 19, created by the gas flow out the engine tube, causes the petal valve member 21 to flex, opening apertures 22 and drawing more air through the venturi throat 27 of the carburetor. The air passing through the carburetor aspirates fuel from passage 77 to provide a combustible mixture. This subsequent charge of fuel and air is ignited and the cycle repeats relatively rapidly, at a rate of the order of sixty to eighty cycles per second. After the original ignition, the subsequent repeated cycles are sustained by the glow coil 12 and the spark plug is energized only during the starting interval and combustion air is supplied through apertures 29. After self-sustaining combustion has started, stroking of the pump 39 is halted and pressure above atmospheric in line 44 and in chamber 37 bleeds off through apertured check valve 41 and bleed aperture 40 respectively, and valve 33, 34 is moved to closed position.

Pressure pulses from the combustion chamber are routed to the carburetor by line 54 and operate the pump formed by diaphragm 58. This pump moves additional fuel from fuel tank 43 into the carburetor chamber 74, its flow being metered by the position of diaphragm 38. When the fuel pump operation has reached a stable condition, operation of the starting pump 39 is halted. Pressure in the fuel tank 43 bleeds off, as previously mentioned, through a bleed opening in the check valve 41, and fuel thereafter is pumped to the carburetor with the fuel tank unpressured.

At start-up the valve 48 controlling the formulation supply line is in closed position and remains so until the engine is in stabilized running operation. When the valve 48 is manually opened, the formulation is forced from tank 46 and delivered through line 47 to the tube 10 to be entrained in the exhaust gases flowing through the exhaust tube. The formulation tank is pressured continuously during engine operation by combustion pressure pulses transferred from the antechamber 19 through the line 51. The bleed opening in the check valve 52 in line 51 permits pressure in tank 46 to bleed away when engine operation is halted. Combustion can be halted by manipulation of control member 56, moving vane 57 in the carburetor throat thereby cutting of the flow of fuel and air to the combustion antechamber. The left hand side of the carburetor shown in FIG. 2 may be considered collectively to form a fuel control means with the chamber 37 and line 36 forming a starting means.

The relatively low physical inertia of the components forming the fuel control means gives a rapid response of the fuel feed rate to a change in air flow through the carburetor throat. No pressurization of the fuel tank is necessary while the fogging device is operating and a stable fuel supply is provided at the carburetor.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pulse fog generator including a combustion device of the resonant intermittant combustion type having a fuel-air inlet valve in which passage of air and fuel to a combustion antechamber is controlled by a conventional petal-type check valve, a carburetor supplying a fuel air mixture to the inlet valve, said carburetor having a throat through which intake air flows at a velocity dependent upon the combustion rate in the combustion device, fuel control means for presenting fuel under pressure at said carburetor throat for aspiration into said intake air flow, said means comprising an aspirating passage opening into said throat and a fuel inlet valve controlling the flow of fuel through said passage, pressure responsive means for varying the flow of fuel through said fuel inlet valve in directly proportional response to the velocity of said intake air flow through the carburetor throat, said pressure responsive means comprising means forming a chamber with said fuel inlet valve providing an inlet for fuel to said chamber and said aspirating passage providing a fuel outlet from said chamber, and a diaphragm forming one wall of said chamber operatively connected to said fuel inlet valve to control the flow of fuel into said chamber in response to the pressure therein, and starting means for altering the response of said pressure responsive means during a start-up interval to thereby present fuel at the junction of said aspirating passage and said throat independently of the air flow therethrough, said starting means comprising means forming a further chamber on the side of said diaphragm opposite said first mentioned chamber, and air supply means for supplying air under pressure for a brief starting interval to said further chamber to thereby temporarily move said diaphragm to open said fuel inlet valve independently of the fuel pressure in said first mentioned chamber.

2. A pulse fog generator as claimed in claim 1 in which fuel under pressure is delivered to said fuel inlet valve by a fuel pump having its suction side connected to a fuel reservoir tank and its discharge side to said fuel inlet valve, said pump having a pressure chamber and a flexible pumping element operable by pneumatic pressure pulses in the pressure chamber and conduit means connecting said pressure chamber with said combustion antechamber whereby combustion pressure pulses from the antechamber operate the fuel pump.

* * * * *